United States Patent [19]

Zucker et al.

[11] 4,190,373

[45] Feb. 26, 1980

[54] METHOD AND APPARATUS FOR MIXING PULVERULENT DRYING SUBSTANCES AND/OR FLUENT MEDIA WITH ONE OR MORE LIQUIDS

[75] Inventors: Friedrich J. Zucker, Neuss; Hans J. Langenbusch, Glessen, both of Fed. Rep. of Germany

[73] Assignee: Supraton F. J. Zucker KG, Neuss, Fed. Rep. of Germany

[21] Appl. No.: 876,162

[22] Filed: Feb. 8, 1978

[30] Foreign Application Priority Data

Feb. 10, 1977 [DE] Fed. Rep. of Germany ..... 2705535

[51] Int. Cl.[2] ..... B01F 7/00

[52] U.S. Cl. ..... 366/160; 366/165

[58] Field of Search ..... 366/152, 160, 162, 165, 366/167, 172–174; 23/271 R, 271 G

[56] References Cited

U.S. PATENT DOCUMENTS

| | | | |
|---|---|---|---|
| 2,906,607 | 9/1959 | Jamison | 23/271 R |
| 3,385,569 | 5/1968 | Bookout | 366/165 |
| 3,425,669 | 2/1969 | Gaddis | 366/165 X |
| 3,762,689 | 10/1973 | Hege | 366/160 X |

*Primary Examiner*—Leonard D. Christian
*Attorney, Agent, or Firm*—Neil F. Markva

[57] ABSTRACT

A method and apparatus for mixing pulverulent drying substances and/or fluid media with one or more liquids are disclosed. The method comprises the steps of supplying a flow of one or more pulverulent drying substances and/or fluid medium and directly subjecting this flow to the action of at least one liquid constituent under high pressure to form a resultant mixture. The apparatus comprises a mixing chamber with at least one inlet for receiving the materials to be mixed and nozzle means for introducing liquid under high pressure into the mixing chamber.

19 Claims, 6 Drawing Figures

METHOD AND APPARATUS FOR MIXING PULVERULENT DRYING SUBSTANCES AND/OR FLUENT MEDIA WITH ONE OR MORE LIQUIDS

BACKGROUND OF THE INVENTION

The invention relates to a method and apparatus for mixing pulverulent drying substances and/or fluent media with one or more liquids. The mixing operation produces a suspension, dispersion or the like.

It is particularly difficult to attain a homogeneous mixing in a continuous process when mixing drying constituents in a wet constituent to produce a homogeneous suspension for dispersion. It is essential that the ratio in parts by weight of solid and liquid be kept constant in such a continuous mixing operation. In a batch process, an agitator may be used in a receptacle to obtain a satisfactory dispersion if the agitation is carried on for a sufficient length of time. However, such a measure is wasteful in energy and time and furthermore cannot be carried out at all times. Bulky mixing devices are necessary to attain an efficient mixing process. Large receptacles are required and consequently the amount of space required is considerable. It is difficult to mix solids in liquids when the solid is to be wetted with small amounts of liquid.

PURPOSE OF THE INVENTION

The primary object of this invention is to produce mixtures or suspensions of pulverulent drying substances and/or fluent media with one or more liquids in which the process for attaining a homogeneous, more or less pasty composition, can be carried out continuously and maintain a constant ratio of the parts by weight of solid and liquid.

SUMMARY OF THE INVENTION

A flow of one or more pulverulent drying substances and/or fluent media is subjected to the action of at least one liquid constituent under high pressure. The mixing is carried out in such a manner as to provide a mixture that is continuously discharged from the apparatus. The liquid constituent is supplied under high pressure through high pressure nozzle means.

The use of at least one jet of liquid under high pressure achieves a mixture of the constituents in a purely hydraulic manner. The predetermined dosage rate of the quantities is preserved while the constituents are brought together. The resultant mixture of the constituents, which may comprise a suspension or dispersion, has the parts by weight of the constituents remain as predetermined in the more or less pasty composition.

By using a hydraulic, high pressure of a liquid constituent, a loss of head is established thereby providing a complete penetration of the drying constituent or constituents with the liquid constituent. This complete penetration is also effected when bringing together large quantities of pulverulent substances with relatively little liquid in order to obtain a homogeneous pasty composition. A subsequent separation of the mixed constituents does not take place. That is, the mixture or suspension and the like, obtained, remains stable for a long time insofar as the homogeneity is concerned. Mixing of the constituents takes place in a very short time. The resultant mixture may be used immediately after mixing.

The expenditure in construction of the apparatus is extremely small. The mixing process may especially be carried out in a continuous operation.

The mixing by means of at least one liquid component under high pressure may be carried out both for one or more pulverulent drying substances and also for fluent media as well as furthermore for drying substances and fluid media at the same time. In the latter case, the drying constituent with addition of one or more liquid constituents, can be mixed with one another beforehand. Furthermore, several liquid constituents can first of all be mixed with one another and the mixture then subjected to the action of at least one jet of liquid under high pressure. It is moreover possible to subject all drying constituents and liquid constituents intended for mixing, at the same time, to the action of the liquid constituent under high pressure without previous mixing. It is furthermore possible to mix still further drying constituents and/or liquid constituents at the same time with a liquid constituent under high pressure.

The constituents being mixed may be brought together in amounts determined in advance with respect to weight or volume. The high pressure liquid is supplied through nozzle means comprising jets at an amount sufficient to generate turbulence in the flow of the drying substance and/or fluent medium. Depending on the kind of pulverulent drying components and/or fluent media, the pressure of the liquid jet is adjusted. The fluent media may consist of water or a solution. The pressure of the liquid jet may be kept within wide limits such as in a range from about 10 to 1000 bar. A more specific range of pressures may be maintained in a range of about 50 to 250 bar.

A further feature of the invention is directed to the specific apparatus used to effect the process of the invention. A conveyor chute may be used to feed the drying substance or the fluent media into a tubular mixing chamber having nozzle inlets for one or more liquids to be introduced under high pressure into the chamber. These high pressure inlets may be circular section discharge nozzles. The nozzles may be directed axially, radially, and/or diagonally, with respect to the longitudinal axis of the tubular mixing chamber. Consequently, turbulences are introduced for pressure mixing into the composition subject to the mixing process. A tangential disposition of the nozzles with respect to the tubular mixing chamber particularly assists in effecting the turbulences desired. The apparatus and method of this invention are especially useful when mixing abrasive media. There are no moving mechanical parts necessary to effect the mixing process of the invention.

The process and apparatus for mixing in accordance with this invention are particularly useful where pulverulent substances can be wetted with a greater or lesser degree of difficulty and are to be mixed with the liquid, solution or the like. This is particularly true where the pulverulent substances swell and gush up upon the addition of a liquid and/or receive viscose qualities to a greater or lesser extent.

The mixing process and apparatus of this invention are particularly useful for producing a cement glue. Such a glue is a water-cement mixture which on the production of concrete components, absorbs the admixed other substances, usually sand and gravel, which is also referred to as aggregate.

The quality of the concrete component is dependent upon the quality of the cement glue. In the present state of the art, the quality of the glue is determined by the quality of the cement being used. Consequently, there are different kinds of cement which produce different criteria both with regard to strength to be anticipated, and with regard to applicability such as, for example, setting time, flowability, and behavior under water. The strength of a concrete component, insofar as it is influenced by the quality of the cement glue, is also influenced by the concentration of the cement glue, i.e., the water-cement ratio.

Cement is an extremely fine product with respect to particle size. Thus, it has a high specific surface which must be wetted with as small an amount of water as possible. At the same time, it is important to have uniform wetting take place so that the penetration of water onto the surface of the cement core may be effected. The water-cement dissemination is of decisive importance with regard to the quality of the cement glue.

In prior art mixing processes, generally, no cement glue is separately produced, but is formed on the simultaneous admixture of additives, cement and water. This prior art mixing procedure can be simply designated as coarse, with regard to the aforementioned micro dimensions of the cement surfaces and the desired degree of dispersion. The mixing procedure may be made in both small and large batches. The small batches are prepared manually in piles. The large batches are prepared in tumbler mixers or agitator mixers in which the agitators often undergo planetary movements.

On the other hand, in accordance with the present invention, surprising results are obtained when cement of the quality 350 to DIN 1164 is brought together with an accelerated or high pressure jet of water. The subsequent cement-water mixture may be introduced into a deviating or deflecting zone to produce the surprising effect that the water absorbing capacity of the cement has considerably increased with respect to a cement glue produced by simply stirring up cement and water. That is, in accordance with one feature of the invention, the cement and water leave the tube at a high speed and are subjected to a deflecting and shearing action of such a nature that they are projected against a plate mounted in front of the tube disposed at approximately or exactly right angles to the same. It is also possible to achieve the desired deflecting and shearing effect in the mixing tube itself. This can be achieved through suitable arrangement of the jet nozzles through which the high pressure liquid is introduced. Thus, the desired effect may be achieved without having the additional deflecting plate after the outlet from the mixing tube.

A spontaneous homogeneous blending of the cement and water is achieved through the high acceleration or high pressure mixing method of this invention. This leads to an optimum dispersion on the surface of the cement of the water in the quantities available. Furthermore, the penetration of the water into the boundary layers of the cement granule is hastened by this procedure and thus, prevents precipitation.

Cement of high strength with advantageous setting behavior is produced in a simple and reliable manner in accordance with this invention. It is not necessary to mix the whole of the additives at the same time with the water. It is advantageous to obtain the direct production of a cement glue in a first stage. This cement glue so produced is then mixed with the additive or, in the event that several are present, with the additives in a second stage following directly thereafter. It is also possible to introduce a portion of the additives with the cement in the previously described tube and undertake a treatment similar to the latter.

The invention may be applied to suspensions strongly subject to swelling. For example, bentonite (active clay) in suspensions may be used for fusing and hardening louvered slides in the building industry. The bentonite suspensions are also used for making smooth and reinforcing bore holes of all kinds in the ground. Chalk and phamaceutical powder may also be mixed according to the invention. In the foodstuffs industry, thickeners such as carrageenan, and the like, play an important role, such as in the production of ice cream. Thickeners are also used in the cosmetic industry such as in the production of toothpaste and the like. All such substances may be transformed into stable mix suspensions, dispersions and the like, in a continuous process by means of the method and the apparatus of this invention.

BRIEF DESCRIPTION OF DRAWINGS

Other objects of this invention will appear in the following description and appended claims, reference being made to the accompanying drawings forming a part of the specification wherein like reference characters designate corresponding parts in the several views.

DESCRIPTION OF SPECIFIC EMBODIMENTS

Figure 1:
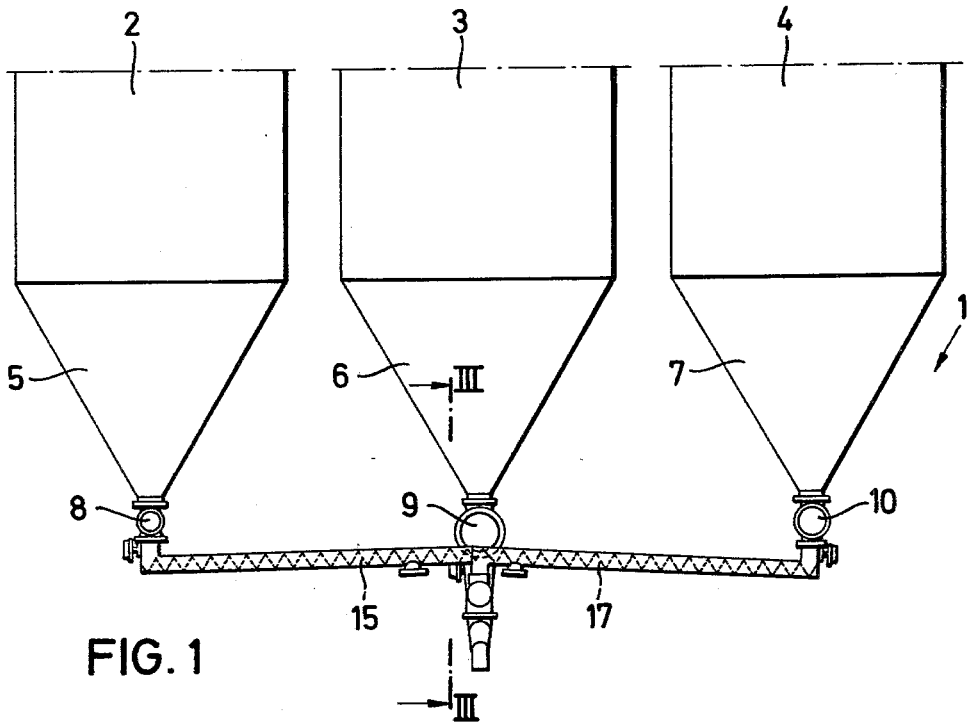
FIG. 1 is a diagrammatic elevational view of a mixing apparatus made in accordance with this invention.
Figure 2:
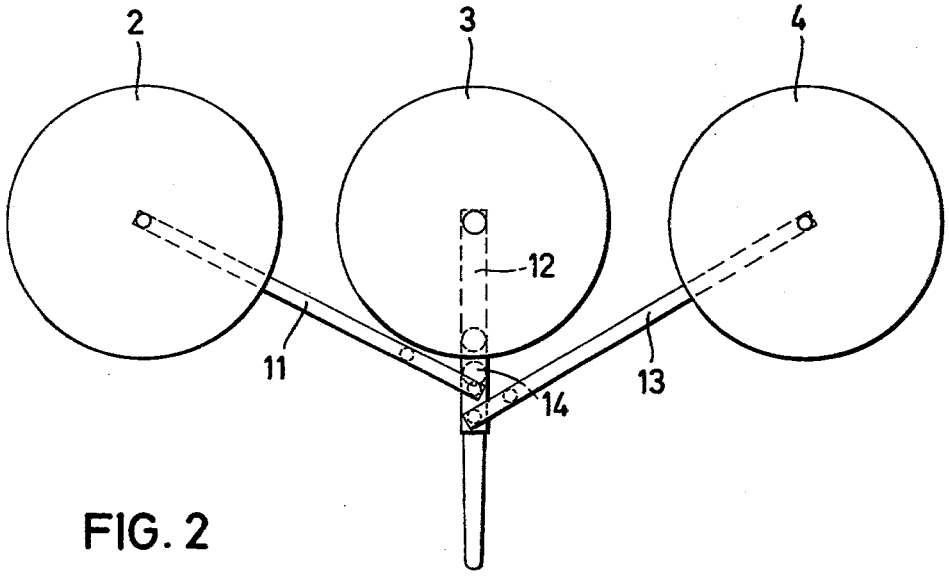
FIG. 2 is a diagrammatic top plan view of the apparatus of FIG. 1.
Figure 3:
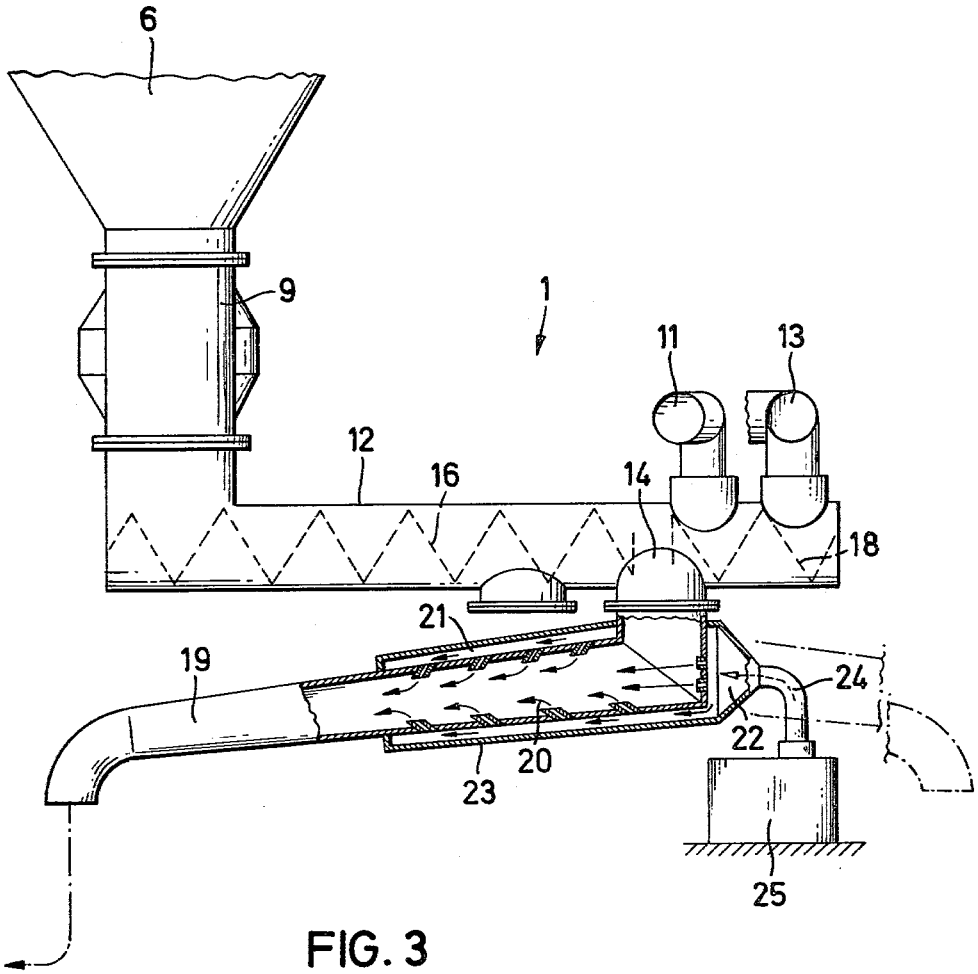
FIG. 3 is a sectional view along line III—III of FIG. 1.

Referring to FIGS. 1–3, several solid constituents may be brought together in the apparatus, generally designated 1. Three supply bins 2, 3 and 4 have funnel-shaped bottom portions and are used to supply different solid constituents to the mixing apparatus. Valved compartments 8, 9 and 10 are located at the lower end of funnel bottom portions 5, 6 and 7, respectively. Conveying tubes 11, 12 and 13 extend from the compartments 8, 9 and 10, respectively, to a common mixing tube 14. Tubes 11, 12 and 13, alternatively, may be conveyor chutes or conveyor belts.

The pulverulent solid constituents and/or fluid media may be removed from the supply bins 2, 3 and 4 in appropriate measured amounts through feeding screws 15, 16 and 17, which rotate at predetermined speeds so that the ratio of the measured amounts of the dry constituents and/or fluent media can be maintained with certainty. An intermediate feeding screw 18 may be provided for the conveyor tubes 11 and 13.

A mixing and discharge chamber 19 is joined to the feed pipe 14 and leads into inlets 20, 21 and 22 for introducing a liquid or water under high pressure. The three constituents are introduced into feed pipe 14 in measured amounts from the tubes 11, 12 and 13. Inlets 20 may comprise one or more circular section and/or flat section discharge nozzles which open into the mixing chamber 19 axially and/or radially. In this embodiment, there are a plurality of jet inlets 20 which open into chamber 19 both axially and radially.

Casing tube 23 surrounds mixing chamber 19. Pipeline 24 leads from a high pressure direct connected motor driven pump 25 into the tube 23 for introducing high pressure liquid through the discharge nozzles 20. Tubular mixing chamber 19 is inclined in this embodiment at an angle to the vertical.

A predosing of constituents in accordance with weight or volume is continuously brought together at the short feed pipe 14. Subsequently, the constituents are subjected simultaneously to the action of high pressure liquid jets through the inlet nozzles 20, 21 and 22. Therefore, the mixing process is carried out fully hydraulically without the assistance of mechanical parts or the like. The liquid jets are under high pressure sufficient to subject the constituents to such a shearing gradient that the finished mixture suspension, dispersion and the like, is available in mixing chamber 19 due to the turbulences brought about by the liquid jets.

The mixing process takes place continuously. The impact effect of the high pressure liquid jets, converts the supply constituents to the desired mixture. When mixing dry constituents, the liquid jets convert these constituents into a desired more or less pasty composition, suspension or dispersion. A complete homogeneity end product is guaranteed by the process of the apparatus in this invention. The end product is stable with respect to its properties of the weight ratio of parts of solid and/or liquid on the one hand and liquid on the other hand. The mixture and the like obtained through the use of this invention can be applied directly to the desired further treatment.

One or more dry components and/or liquid components may be added to the mixture obtained. The addition of components may take place either simultaneously with the high pressure liquid jet or simply introduced within the mixing zone.

The homogeneous end product may be introduced directly into vessels or receptacles, such as tank trucks and the like. Consequently, there is no danger of possible separation of the constituents while being transported through a more or less long conveying path. The apparatus of this embodiment has the tubular mixing chamber 19 mounted to swing horizontally in any desired known manner about the short feed pipes 14. Thus, in the continuous operation of the apparatus, a series of conveyor receptacles and the like can be filled, one after the other, without interruption in the continuous process.

Figure 4:
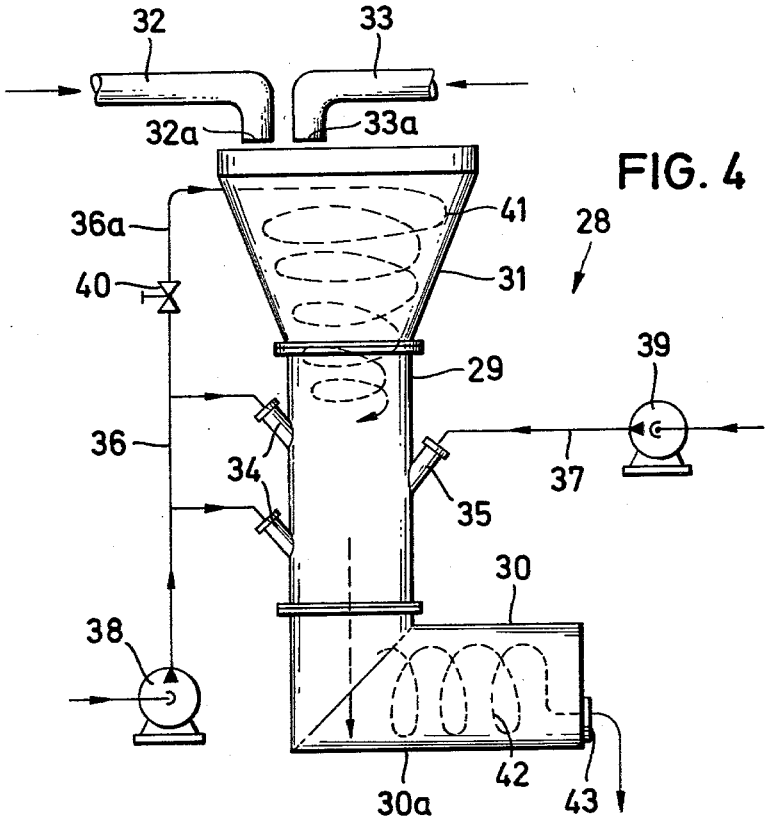
FIG. 4 is a diagrammatic elevational view of a further embodiment of a mixing apparatus made in accordance with this invention.
Figure 5:
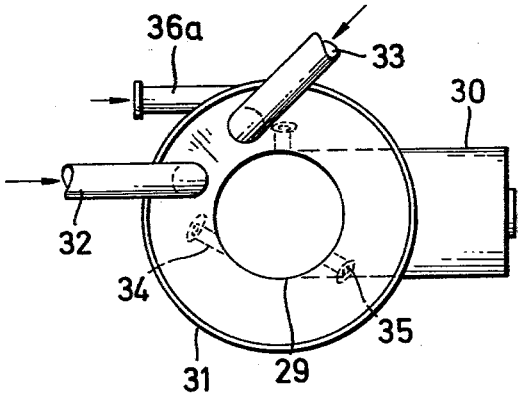
FIG. 5 is a top plan view of the mixing apparatus of FIG. 4.

Referring to FIGS. 4 and 5, mixing apparatus 28 has a vertically extending mixing chamber 29 with a right angled or approximately right angled angular chamber portion 30 which may be tubular. Funnel 31 sets upright on the tubular mixing chamber 29. Solid constituents are supplied in premeasured quantities through pipelines 32 and 33 into funnel 31. Nozzles 34 and 35 are directed at an acute angle to the axis of the mixing chamber 29. Liquid material is introduced through nozzles 34 and 35 under high pressure into mixing chamber 29 through supply pipelines 36 and 37. High pressure pumps 38 and 39 provide the liquid under pressure.

A branch pipeline **36*a* leads from the supply pipeline 36 to funnel 31 and opens tangentially to said funnel. Pressure of the liquid is regulated by means of valve 40 located in branch pipeline 36*a*. Outlets 32*a* and 33*a* of constituent supply pipelines 32 and 33, respectively, are disposed at the side of funnel 31. Thus, solid constituents come together directly with a liquid vortex 41 supplied through the branch pipeline 36*a*. Thereafter, the dry components prewetted with liquid are subjected in the vertical mixing chamber 29 to the high pressure liquid jets from nozzles 34 and 35 with a high shearing gradient which produces turbulences. The total mixture then strikes on the lower portion 30*a* of the angular chamber portion 30 with high acceleration and impetus. Further considerable turbulences 42 are produced through the deflection of the solid-liquid mixture and the rebound effect when the mixture strikes bottom portion 30*a*. The prepared mixture passes through outlet 43** for further utilization of processing. This described arrangement is particularly suitable for the production of a finely divided cement glue.

Figure 6:
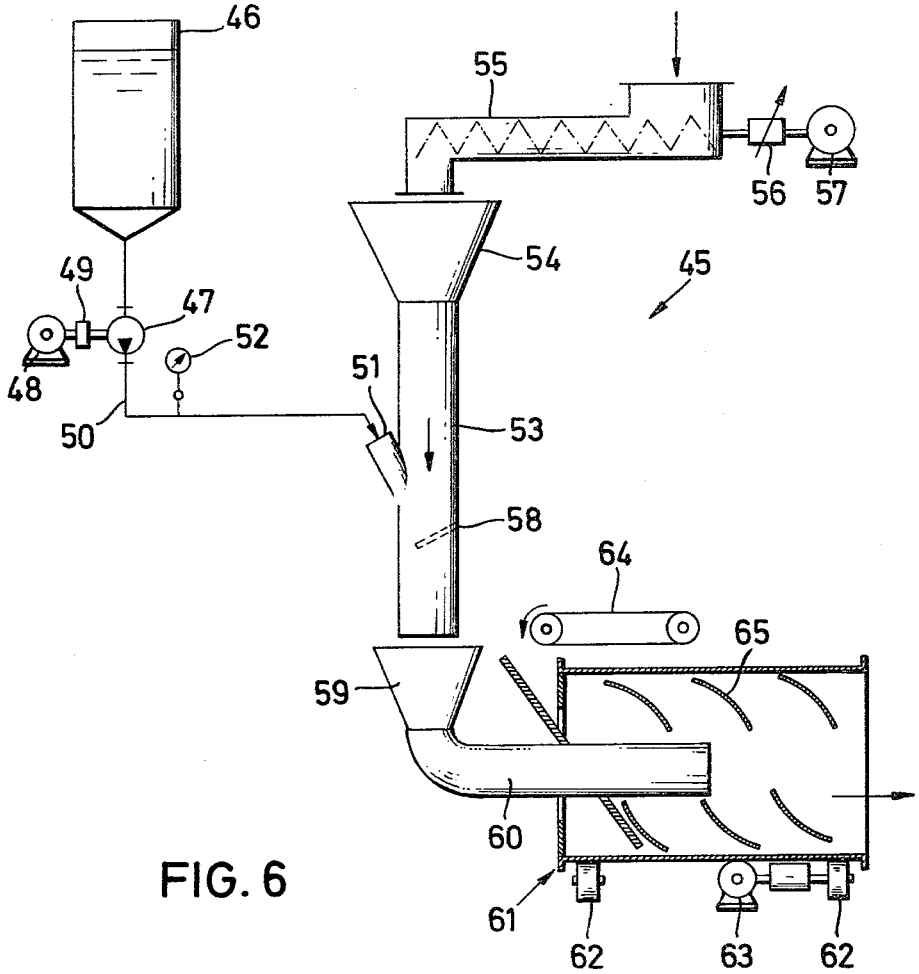
FIG. 6 is a diagrammatic elevational view partially in section of a still further embodiment of an apparatus made in accordance with this invention.

The apparatus, generally designated 45, in FIG. 6 is useful for the production of a cement glue. Water is brought from a storage vessel 46 at a pressure of about 45 bar through a high pressure piston pump 47 which is driven by an electric motor 48 by way of couplings 49. The water is supplied through pipeline 50 to one or more nozzles 51 disposed around the mixing chamber 53. Manometer 52 is built in pipeline 50 for control of the pressure upstream of the nozzles 51. Nozzle 51 is disposed at an angle of about 23° with respect to the longitudinal axis of the upright tubular mixing chamber 53.

A funnel-shaped attachment 54 is disposed at one end of the chamber 53 and receives cement supplied through a proportioning screw 55. The amount of cement and the water-cement ratio can be varied through the stepless gear 56 with a motor 57. Plate 58 located within the chamber 53 and disposed below nozzle 51 includes a surface which is provided with a wear resistant material such as nickel-silicone-steel-iron alloy. The cement and water mixture rebounds at high speed on the upper surface of plate 58 and flows partially through rebound energy and partially because of its own weight into the funnel 29 located below chamber 53. The mixture then moves through the outlet pipeline 60 into the interior of mixing drum 61.

Drum 61 is disposed substantially horizontally on the roller support 62 and is rotated through the action of electric motor 63. A premeasured amount of aggregate is also introduced into the drum 61 by the conveyor belt 64. By rotating drum 61, the cement glue already prepared at this stage is mixed with the aggregates and uniformly distributed on the surface of the aggregates. The mixture is then delivered to the drum outlet by delivery members 65 arranged internally of drum 61. Delivery members 65 form an angle with respect to the longitudinal axis of drum 61.

ADVANTAGES OF THE INVENTION

An arrangement made in accordance with this invention enables a high production capacity to be achieved and a qualitative high grade of concrete to be produced with a relatively small technical expenditure. Surprising results have been obtained through the use of apparatus described herein. These results of the use of the apparatus as described herein are numerically expressed in comparison to a conventional or customary agitating apparatus. The mixture of 1,000 grams of cement and 600 grams of water was stirred intensively for five minutes in a conventional apparatus having a three bladed tubular stirrer. The stirrer was operated at a speed of rotation of 1,140 rpm in a vessel of 2,000 $cm^3$ and a diameter of 100 mm. A portion of the resultant mixture was then transferred into a vertical cylinder which had a scale division. Through the latter, a deposit of the cement portion in the mixture of 20.2% could be ascertained after one hour.

By comparison, the same cement water mixture was mixed with the same amount of water in accordance with the invention. However, the water was introduced into the mixing chamber through a tube disposed at an angle of about 20° with respect to the longitudinal axis of the mixture chamber and at a pressure of 40 bar. The nozzles through which the water was introduced had a diameter of 1 mm. The mixing chamber had an internal diameter of 74 mm and a length of 480 mm, and was arranged vertically. Thus, the acute angle formed by the axis of the nozzle with the longitudinal axis of the tube pointed approximately in the direction of the center of the earth. Consequently, it is possible to introduce free-falling cement into the side of the tube which forms an acute angle with the water introducing nozzle. This procedure is supported by the fact that required by the speed of the water, there is a subpressure at the upper end of the mixing tube. After transfer of the mixture into a vertical cylinder, there was, after an hour, a deposit of the cement portion in the mixture of only about 10%. In other words, the mixing zone is maintained substantially free from an accumulation of the finished resultant mixture.

The technique described above represents only one of the possible forms of the method according to the invention. This method may have application with results just as good in a form that can be introduced into the present mixing plants which usually operate with planetary mixers. Here, the mixture, made according to the invention, and the prepared cement glue are added to the aggregate in the planetary mixer and mixed with the aggregate.

While the method and apparatus for mixing pulverulent drying substances and/or fluent media with one or more liquids has been shown and described in detail, it is obvious that this invention is not to be considered as being limited to the exact form disclosed, and that changes in detail and construction may be made therein within the scope of the invention, without departing from the spirit thereof.

Having thus set forth and disclosed the nature of this invention, what is claimed is:

1. A method for mixing pulverulent drying substances and/or fluid media with one or more liquids, especially to produce a suspension, dispersion or the like, said method comprising the steps of:

(a) supplying a flow of at least one pulverulent drying substance and/or fluid medium in a mixing zone, (b) directly subjecting said flow to the action of at least one liquid constituent under high pressure sufficient to continuously mix and to form a finished resultant mixture within the mixing zone, and (c) continuously discharging said mixture from the mixing zone, (d) said drying substance and/or fluid medium and high pressure liquid constituent being supplied in a predetermined ratio in accordance with weight or volume.

2. A method as defined in claim 1 wherein said supplying step includes mixing the drying constituents with one another with the addition of one or more liquid constituents to form a first mixture, and subjecting said first mixture to the action of said at least one liquid constituent under high pressure to form a second mixture which is continuously discharged.

3. A method as defined in claim 1 wherein said supplying step includes mixing several liquid constituents with one another to form a first mixture, and subjecting said first mixture to the action of said at least one liquid component under high pressure to form a second mixture which is continuously discharged from the mixing zone.

4. A method as defined in claim 1 wherein said directly subjecting step includes supplying the high pressure liquid from a jet which generates turbulences to the drying and/or liquid constituents within the mixing zone.

5. A method as defind in claim 1 wherein the high pressure liquid is maintained at a pressure of about 10 to 1000 bar.

6. A method as defined in claim 5 wherein said high pressure liquid jet is maintained at a pressure of from about 50 to 250 bar.

7. A method as defined in claim 1 including adding the drying constituents and/or liquid constituents to the resultant mixture obtained with the liquid constituents under high pressure.

8. A method as defined in claim 1 used for producing a binding glue such as cement glue from a mineral binding agent, wherein said flow of said supplying step includes a binding agent, and said liquid constituent is water under a pressure of at least 8 bar to form a resultant glue mixture, and after said directly subjecting step, subjecting said resultant glue mixture by means of a high pressure liquid jet in a direct flow to a rebounding and shearing stress, and shortly thereafter, mixing said resultant glue mixture with aggregates.

9. A method is defined in claim 8 wherein said aggregate mixing step includes mixing the resultant glue mixture in a rotating tube with the aggregates.

10. A method as defined in claim 8 wherein said aggregate mixing step includes supplying the solid aggregates required for production of a concrete mix continuously through proportioning devices in amounts variable in accordance with the intended application, and adding the required amount of water in continuously measured amounts appropriate to the presecribed cement-water ratio.

11. An apparatus for mixing pulverulent drying substances and/or fluid media with one or more liquids, said apparatus comprising:

(a) a mixing chamber defining a mixing zone and having at least one inlet for receiving a first material comprising pulverulent drying substances and/or fluid media, (b) nozzle means for introducing liquid into said mixing zone at the mixing chamber simultaneously with said first material at a pressure sufficient to form a finished resultant mixture within the mixing zone, and (c) outlet means for continuously discharging said resultant mixture from the mixing zone.

12. An apparatus as defined in claim 11 including a conveyor device disposed upstream of the mixing chamber for transporting pulverulent drying substances and/or fluid media, said conveyor device including proportioning means for feeding measured amounts to the mixing chamber.

13. An apparatus as defined in claim 12 wherein said proportioning means comprises a feeding screw.

14. An apparatus as defined in claim 11 wherein the mixing chamber is tubular, and the nozzle means are effective to introduce said high pressure liquid tangentially to the tubular mixing chamber.

15. An apparatus as defined in claim 11 wherein the mixing chamber is tubular, and said nozzle means includes a tubular mixing casing surrounding said tubular mixing chamber, and a high pressure motor driven pump and further including a pipeline connected to said casing and directly leading from said high pressure motor driven pump.

16. An apparatus as defined in claim 11 wherein the mixing chamber is mounted at said one inlet to swing horizontally.

17. An apparatus as defined in claim 11 wherein the mixing chamber extends vertically and has an angularly disposed chamber portion below said nozzle means.

18. An apparatus as defined in claim 17 wherein the angularly disposed chamber portion is at an angle of about 90° to the axis of the mixing chamber, said angularly disposed chamber portion has a bottom surface serving as a rebound surface.

19. An apparatus as defined in claim 11 including a funnel-shaped member disposed on the mixing chamber, and means for introducing liquid at a predetermined pressure in a tangential direction into the funnel-shaped member.

* * * * *